United States Patent [19]

Stern

[11] Patent Number: 4,644,676

[45] Date of Patent: Feb. 24, 1987

[54] FIREARM SAFETY APPARATUS

[76] Inventor: Michael A. Stern, 1030 N. Maclay Ave., San Fernando, Calif. 91340

[21] Appl. No.: 752,804

[22] Filed: Jul. 8, 1985

[51] Int. Cl.[4] ..... F41C 27/10

[52] U.S. Cl. ..... 42/70.07; 224/911

[58] Field of Search ..... 42/1 N, 1 Y, 70.07; 150/52 R; 224/913, 911; 128/165

[56] References Cited

U.S. PATENT DOCUMENTS 3,279,459 10/1966 Schenker ..... 128/165
4,395,837 8/1983 Durnal ..... 42/1 Y

FOREIGN PATENT DOCUMENTS 74933 6/1917 Fed. Rep. of Germany ..... 42/1 N
4626 of 1905 United Kingdom ..... 42/1 Y

OTHER PUBLICATIONS

*Popular Mechanics,* "Trigger 'Safe' Locks Out Accidents", p. 146, Feb. 1948.

*Primary Examiner*—Deborah L. Kyle
*Assistant Examiner*—Michael J. Carone
*Attorney, Agent, or Firm*—Michael A. Painter

[57] ABSTRACT

The present invention comprises a safety apparatus which is specifically adapted to prevent inadvertent access to the trigger of a firearm. A band of flexible material is wrapped about the trigger guard, trigger and breech of a rifle or pistol. An elastic or stretchable insert is mounted within one end of the band and adapted to fit about the trigger guard to maintain the band in a fixed location. One end of the band is detachably coupled to the other fixing the band in place to prevent inadvertent contact with the trigger of the firearm which is disposed between the elastic member and the adjacent surfaces of the securing band.

4 Claims, 4 Drawing Figures

FIREARM SAFETY APPARATUS

BACKGROUND OF THE INVENTION

1. Field of the Invention

The present invention generally relates to devices used to prevent inadvertent discharge of firearms, and more particularly, to those devices which can be easily removed.

2. Prior Art

Numerous devices are described in the prior art which are to be used to prevent inadvertent contact with the trigger of a firearm. A typical example is a trigger protector wherein a metallic cup encloses the trigger guard of a firearm and is attached to the firearm by a pair of metallic straps which pass over the top of the firearm and are secured to the metallic cup by a lock. The principal disadvantage of this type of device is that the length of time required to remove the protection device makes it unsuitable when the firearm must be available for instant use.

Another category of firearm protection devices are intended to be used with handguns to maintain the hammer in a cocked position. In these devices, a strap generally fits about the hammer assembly of the firearm and is either affixed about the trigger guard or the trigger itself. The inadequacy of this type of device is evident. Initially, it is clear that the only applicability of the device is to firearms which have accessible hammer assemblies. This eliminates its use for substantially all rifles and those handguns which do not have the hammer assembly exposed.

The present invention substantially resolves those problems which are inherent in the devices taught by the prior art. A flexible band is adapted to fit totally about the trigger guard and breech of a pistol or rifle. An elastic or stretchable insert is mounted substantially adjacent one end of the band, the elastic insert being adapted to fit about the trigger guard. The end of the band opposite the elastic insert is disposed about the breech of the firearm and detachably secured to the end of the band adjacent the elastic insert. The elastic insert maintains the band in a fixed position since it fits about the trigger guard. By providing for a detachable coupling, e.g., hook and loop (Velcro) fasteners, the firearm can be made available for instantaneous use.

SUMMARY OF THE INVENTION

The present invention provides for a firearm safety device which prevents inadvertent access to the trigger assembly of the firearm while simultaneously allowing the firearm to be available for instantaneous use when necessary. A planar band is formed from a flexible material and is of sufficient length to be wrapped about the trigger guard and breech of a pistol or rifle. An elastic member is secured within the band at substantially adjacent one end thereof. The elastic member is substantially rectangular in contour and is adapted to be disposed about the trigger guard of the firearm. The elastic member is stretched about the trigger guard and the opposite end of the band wrapped about the breech of the firearm and detachably secured to the end of the band adjacent the elastic member. When in place, the trigger assembly of the firearm will be enclosed within the elastic member and the adjacent surfaces of the band. Since the elastic will fit tightly about the trigger guard, inadvertent access to the trigger will be prevented. By using conventional hook and loop fasteners, the band can be quickly removed to allow for instant access to the firearm should such become necessary. The exposed surface of the band is adapted to receive indicia to indicate that the firearm is loaded and should be treated with caution.

It is therefore an object of the present invention to provide an improved firearm protection apparatus.

It is another object of the present invention to provide a firearm protection apparatus which can be used on pistols and rifles.

It is still yet another object of the present invention to provide a firearm protection apparatus which can be quickly removed for access to the firearm.

It is still yet another object of the present invention to provide a firearm protection apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
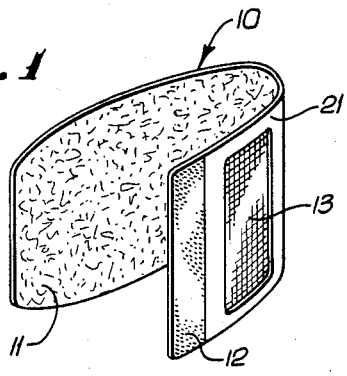
FIG. 1 is a perspective view of the preferred embodiment of the present invention.

The present invention can be best understood by reference to FIG. 1 wherein a perspective view of the preferred embodiment of the present invention is shown. The basic structure comprises a sheath or band 10 which is substantially rectangular in contour and is sufficiently long to be disposed about the trigger guard and barrel of a pistol or rifle. Band 10 is fabricated from a non-stretchable, flexible material such as cloth. The material must be strong but also have the flexibility to be tightly wrapped about the firearm. In the preferred embodiment of the present invention, the material from which band 10 is fabricated has a surface 11 of suitable material for mating to a hook and loop fastener. The opposed surface 21 is preferably smooth and is adapted to receive indicia to indicate that the firearm is loaded and should be treated with caution. As will be described in more detail hereinbelow, the present invention is intended to overcome one of the problems inherent in the devices taught by the prior art by allowing quick removal of the invention from the firearm. As shown in FIG. 1, one surface 11 of band 10 provides for the mating portion for the hook and loop fastener 12 (Velcro). Substantially adjacent one end of band 10, an elastic or stretchable insert 13 is secured. Elastic insert 13 is securely affixed within the confines of band 10 and is preferably disposed across substantially the entire width of band 10. In the embodiment shown in FIG. 1, the contour of elastic insert 13 is rectangular although any suitable shape can be employed. The hook and loop fastener 12 is secured to band 10 at the end thereof adjacent insert 13 and on the surface opposite the mating portion 11. As is clear from FIG. 1, band 10 is adapted to be disposed about the firearm with the hook and loop fastener 12 to lie adjacent the mating surface 11.

Figure 2:
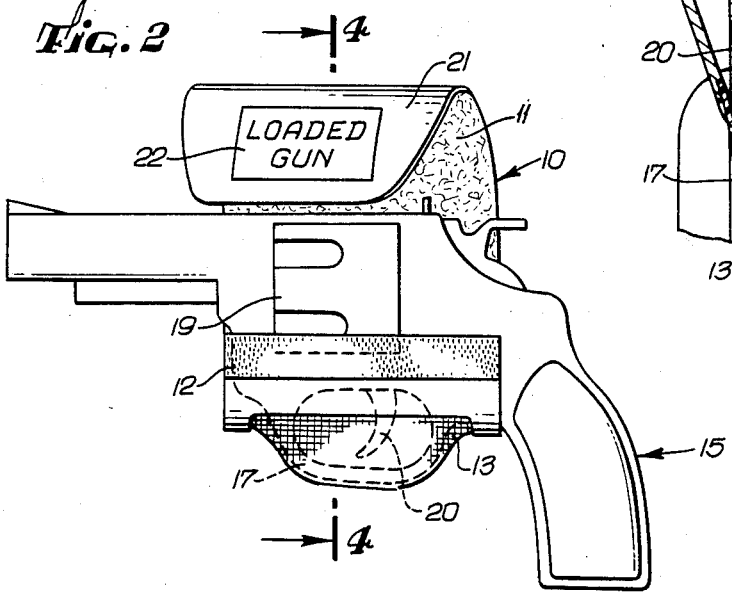
FIG. 2 is a side view illustrating the embodiment of the invention of FIG. 1 affixed about the trigger guard and breech of a pistol.
Figure 3:
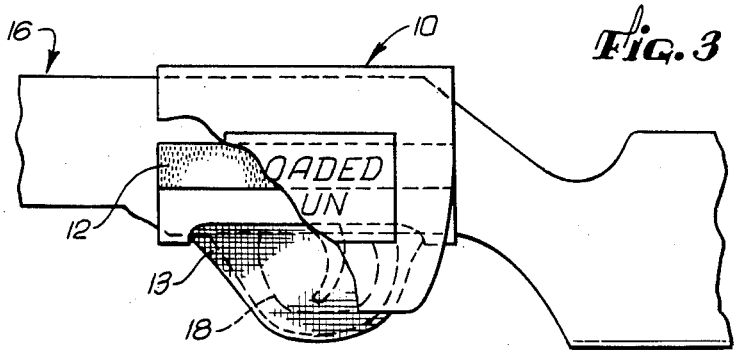
FIG. 3 is a side view illustrating the embodiment of the invention of FIG. 1 affixed about the trigger guard and breech of a rifle.

The attachment of the present invention to either a pistol 15 or a rifle 16 can be best seen by reference to FIGS. 2 and 3, respectively. As shown in FIG. 2, the band 10 is wrapped about trigger guard 17 and the breech 19 of pistol 15. After stretching elastic insert 13 about trigger guard 17, hook and loop fastener 12 is secured to mating surface 11. As can be seen in FIG. 2, surface 21 is opposite to mating surface 11. Surface 21 preferably is adapted to receive printed indicia 22 which indicates that the firearm is loaded. Indica 22 can be applied either by conventional printing or through the applicaton of a separate label. The present invention is mounted upon rifle 16 in precisely the same manner. Band 10 is wrapped about the trigger guard 18 and breech of rifle 16. After stretching insert 13 about trigger guard 18, hook and loop fastener 12 is affixed to mating surface 11.

Figure 4:
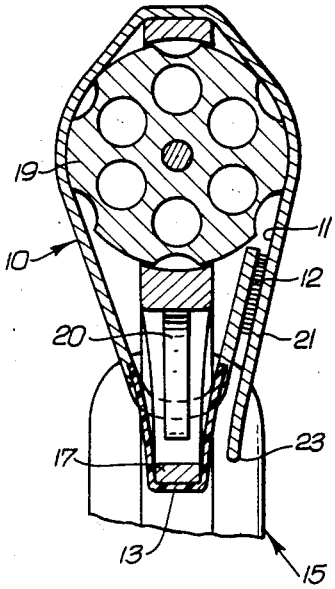
FIG. 4 is an enlarged, cross-sectional view of the mounted embodiment of the present invention taken through line 4—4 of FIG. 2.

The protection afforded by the present invention can be best understood by reference to FIG. 4 wherein an enlarged cross-sectional view of the invention attached to pistol 15 can be best seen. As stated previously, an objective of the present invention is to prevent inadvertent access to the trigger assembly of a firearm. As shown in FIG. 4, elastic insert 13 is stretched about trigger guard 17. Band 10 is wrapped about the barrel and breech 19 and disposed adjacent the surface of pistol 15. Hook and loop fastener 12 is then mated with surface 11 to maintain the protection apparatus in place. When attached, trigger 20 is disposed between the surfaces of band 10 and elastic insert 13. Since elastic insert 13 is firmly secured about trigger guard 17, band 10 cannot be inadvertently dislodged since elastic insert 13 forms a rigid sheath about trigger 20.

One of the objects of the present invention was to provide a firearm safety device which would allow instant access to the firearm if such became necessary. The preferred embodiment of the present invention employs hook and loop fastener 12 and a mating surface 11. Since only a moderate force applied at end 23 is required to separate fastener 12 from mating surface 11, it is clear that the band 10 can be easily removed when necessary. Although a preferred form for fastening means employs the use of a hook and loop surface 12 and a mating surface 11, it is clear that other conventional detachable fasteners can be employed. This would include snaps, hook and eye fasteners, or other like devices.

It can therefore be seen that the present invention substantially resolves those problems inherent in devices taught by the prior art. The use of multiple straps and rigid structural surfaces have been eliminated through the use of band 10 and elastic insert 13. Most importantly, the ability to maintain instant access to the firearm is provided through the use of the preferred fastening means which uses a Velcro hook and loop fastener 12 and a mating surface 11. It can therefore be seen that the present invention provides for an improved firearm safety apparatus.

I claim:

1. An improved firearm safety apparatus in combination with a firearm having a trigger guard wherein the improvement comprises:

(a) a substantially rectangular, uniformly flexible sheath having first and second opposed, planar surfaces and an aperture therethrough substantially at a first end thereof, said aperture being disposed perpendicular to the longitudinal axis of said rectangular sheath, said sheath being adapted to be wrapped about the trigger guard of the firearm (b) an elastic insert secured to said sheath fully enclosing said aperture, said insert being parallel to the first and second opposed, planar surfaces; and (c) a hook and loop fastener having two mating portions, one portion secured to the first surface of said sheath adjacent said elastic insert, the second portion being secured to the second surface of said sheath at the second end of said sheath.

2. An improved firearm safety apparatus in combination with a firearm having a trigger guard wherein the improvement comprises:

(a) a sheath comprised of a planar band having first and second ends and first and second opposed surfaces, said sheath having an opening through said first and second opposed planar surfaces substantially adjacent the first end thereof and being adapted to be wrapped about the trigger guard of the firearm;

(b) an elastic insert disposed within and enclosing the opening through the first and second surfaces of said sheath, said insert being secured to said sheath adjacent the opening therethrough and forming a surface parallel to the first and second surfaces of said sheath;

(c) fastening means for detachably securing the sheath about the firearm whereby said elastic insert is stretched about the trigger guard.

3. An inproved firearm safety apparatus as defined in claim 2 wherein said fastening means comprises a hook and loop fastener having two mating portions, one portion being secured to the first surface of said sheath adjacent said elastic insert, the second portion being secured to the second surface of said sheath at the second end of said sheath.

4. An improved firearm safety apparatus as defined in claim 2 wherein said sheath is substantially rectangular and said elastic insert extends substantially across the entire width of said sheath.

* * * * *